United States Patent [19]

Poldervaart

[11] Patent Number: 4,784,079

[45] Date of Patent: Nov. 15, 1988

[54] APPARATUS SUCH AS A WORKING PLATFORM WHICH BY MEANS OF TENSION LOADED TENSION MEMBER HAS BEEN ANCHORED AND WHICH HAS BEEN PROVIDED WITH MEANS FOR MOORING A VESSEL

[75] Inventor: Leendert Poldervaart, La Turbie, France

[73] Assignee: Single Buoy Moorings Inc., Marly, Switzerland

[21] Appl. No.: 104,233

[22] Filed: Oct. 5, 1987

[30] Foreign Application Priority Data

Oct. 8, 1986 [NL] Netherlands ..... 8602526

[51] Int. Cl.[4] ..... B63B 21/00

[52] U.S. Cl. ..... 114/230; 441/3; 114/264

[58] Field of Search ..... 441/3-5; 114/264, 265, 230, 293; 405/224

[56] References Cited

U.S. PATENT DOCUMENTS

| | | | |
|---|---|---|---|
| 3,778,854 | 12/1973 | Chow | 441/4 |
| 4,534,740 | 8/1985 | Poldervaart | 441/4 |

FOREIGN PATENT DOCUMENTS

| | | | |
|---|---|---|---|
| 2188558 | 1/1974 | France . | |
| 2579558 | 10/1986 | France . | |
| 7610213 | 3/1977 | Netherlands . | |
| 7614022 | 6/1977 | Netherlands . | |
| 7804044 | 10/1978 | Netherlands . | |
| 7901416 | 2/1979 | Netherlands | 441/3 |
| 7800366 | 7/1979 | Netherlands . | |

OTHER PUBLICATIONS

"Cylindrical semi can produce in 300-meter water depths", *Offshore*, vol. 44, No. 1, Jan. 1984, pp. 58-60.

*Primary Examiner*—Joseph F. Peters, Jr.
*Assistant Examiner*—Jesus D. Sotelo
*Attorney, Agent, or Firm*—Young & Thompson

[57] ABSTRACT

Tension leg platform with vessel moored to the platform by a soft yoke mooring system connected to a turntable which is rotatable about a central column of the platform, the platform being free from obstacles between the working area and the body with buoyancy to enable the moored vessel to swing around the artificial island.

2 Claims, 2 Drawing Sheets

Figure 1:
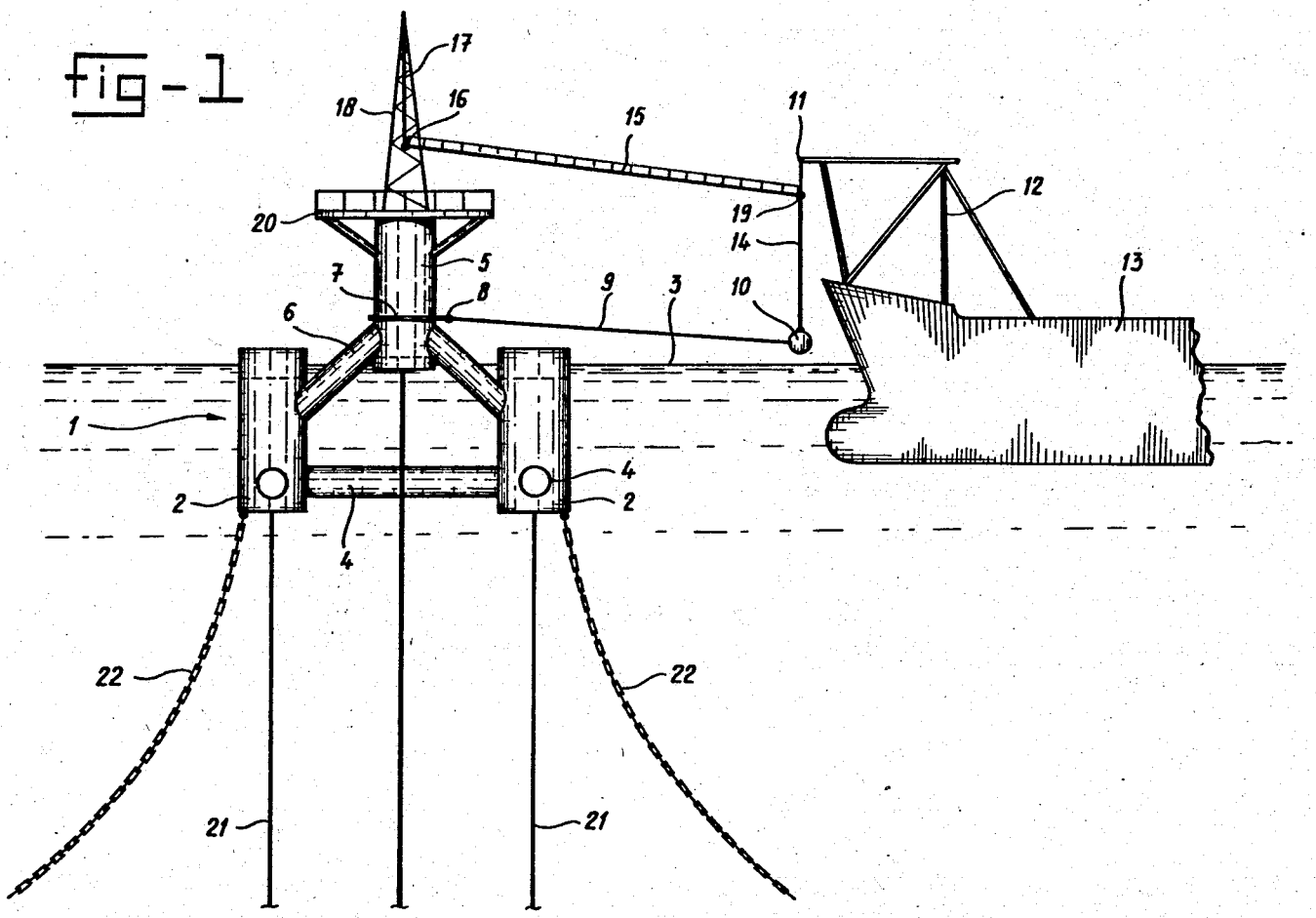

APPARATUS SUCH AS A WORKING PLATFORM WHICH BY MEANS OF TENSION LOADED TENSION MEMBER HAS BEEN ANCHORED AND WHICH HAS BEEN PROVIDED WITH MEANS FOR MOORING A VESSEL

The invention relates to an apparatus comprising a body with buoyancy which by means of a plurality of tension members, which are exclusively designed for taking up tension load has been anchored to one or more bottom anchors located vertically below the body with buoyancy, which body with buoyancy is pulled downwardly by means of said tension members against the buoyant capacity of the buoyant body, which body with buoyancy substantially extends below water and intersects the water level and above the water level supports a portion for performing operations, such as a platform and/or drilling tower.

An apparatus of this type is known from e.g. U.S. Pat. No. 3,648,638. Said tension leg platforms in general have large dimensions. The body with buoyancy usually is formed by a plurality of columns each intersecting the water level and supporting with their ends emerging from the water level a platform. Said artificial islands, which have limited movability in horizontal direction such that the work, such as drilling, can continue, are suitable for work in deep water. They are reasonably stably kept at their location due to the fact that the tension loaded members or legs immediately deliver a return force if the artificial island is displaced.

Said artificial islands, however, are not convenient for mooring large vessels which may move freely with respect to the island under the influence of wind and current. In practice such large vessels, such as tankers, are moored at a distance from the artificial island such as by making use of a separate buoy.

Purpose of the invention is to give said artificial island ā shape such that they are suitable for mooring vessels to them.

According to the invention this purpose is achieved in that the body with buoyancy carries the part for performing operations by means of a single vertical column or sleeve extending above the water level, the horizontal dimensions of which are smaller than those of the body with buoyancy, which column or sleeve is surrounded by a rotatable ring having a stationary part connected to the column or sleeve and a part movable with respect thereto around the column or sleeve, said movable part having means for mooring a vessel comprising a rigid arm, rotatably connected about a horizontal axis to the movable part of the rotatable ring and at a distance from said horizontal pivot axis being suspended from the vessel by means of a tension member, which tension member is loaded by means of a weight whilst the area around the column or sleeve within which the mooring connection between vessel and column or sleeve is located, is free of obstacles such that the vessel can freely swing around the column or sleeve.

Tension forces, which through the intermediance of the soft yoke mooring system formed by the rigid arm and the weight loaded suspension from the vessel, act upon the island, are resiliently taken up by the mass of the island and if needed by the tension loaded legs.

The soft yoke mooring connection known in principle in itself, provides for a more or less permanent connection with the artificial island with the advantage that other vessels, such as tankers, can moor alongside the more permanently connected vessel.

Storage of the product can take place on board of the moored vessel and said vessel now can have the accommodation for personnel as well as at least part of the factory necessary to deal with the crude product and to change it in a product more suitable for transportation. Due to this the dimensions of the artificial islands, in particular of the platform, can be smaller.

It is observed that the above mentioned soft yoke mooring system is known in itself from e.g. the published Dutch patent application No. 8202335 corresponding to U.S. Pat. No. 4,568,295. Such a mooring system now opens the possibility to arrange between the weight loaded tension members suspended from the vessel and the artificial island a second rigid arm one end of which is pivotably connected to the tension member adjacent to its point of suspension and the end turned away from the vessel is swingably suspended from a part of the platform for performing operations located above the rotatable ring. Said second rigid arm can form a bridge between vessel and working platform and/or a support for conduits. Said second rigid arm allows movement of island and vessel with respect to each other, but at the locations of said second arm the movements of said arm with respect to the vessel are minor whilst at the other end the swingable suspension of said second arm allows movements with respect to the working platform but below said end of the rigid arm the working platform can have a surface area which is sufficiently large to allow that one can reach said second arm.

It is observed that from French specification No. 2,579,558 an artificial island is known with a turntable and with a rigid arm connected about a horizontal pivot shaft to the turntable and connected to the vessel.

In this construction, however, the rigid arm for mooring the vessel has been provided with floats and the vessel itself is anchored to said arm by means of chains. Moreover the artificial island is not a tension leg island but an island solely held in place by means of catenary extending anchor chains.

It is further observed that from published Dutch patent application No. 7610213 corresponding to U.S. Pat. No. 4,078,584 an apparatus is known with buoyancy having the buoyant body substantially below water level and having a central column extending through the water level. A vessel is in the environment of said apparatus and a conduit is shown between the apparatus and the vessel. No mooring system has been disclosed.

The body wth buoyancy is connected to a bottom anchor by means of conduits which are able to take up some tension. A conduit which is able to take up some tension, however, is not a tension leg capable of keeping an artificial island at its location.

The invention now will be further elucidated with reference to the drawings.

FIG. 1 diagrammatically shows a first embodiment of the apparatus according to the invention.

Figure 2:
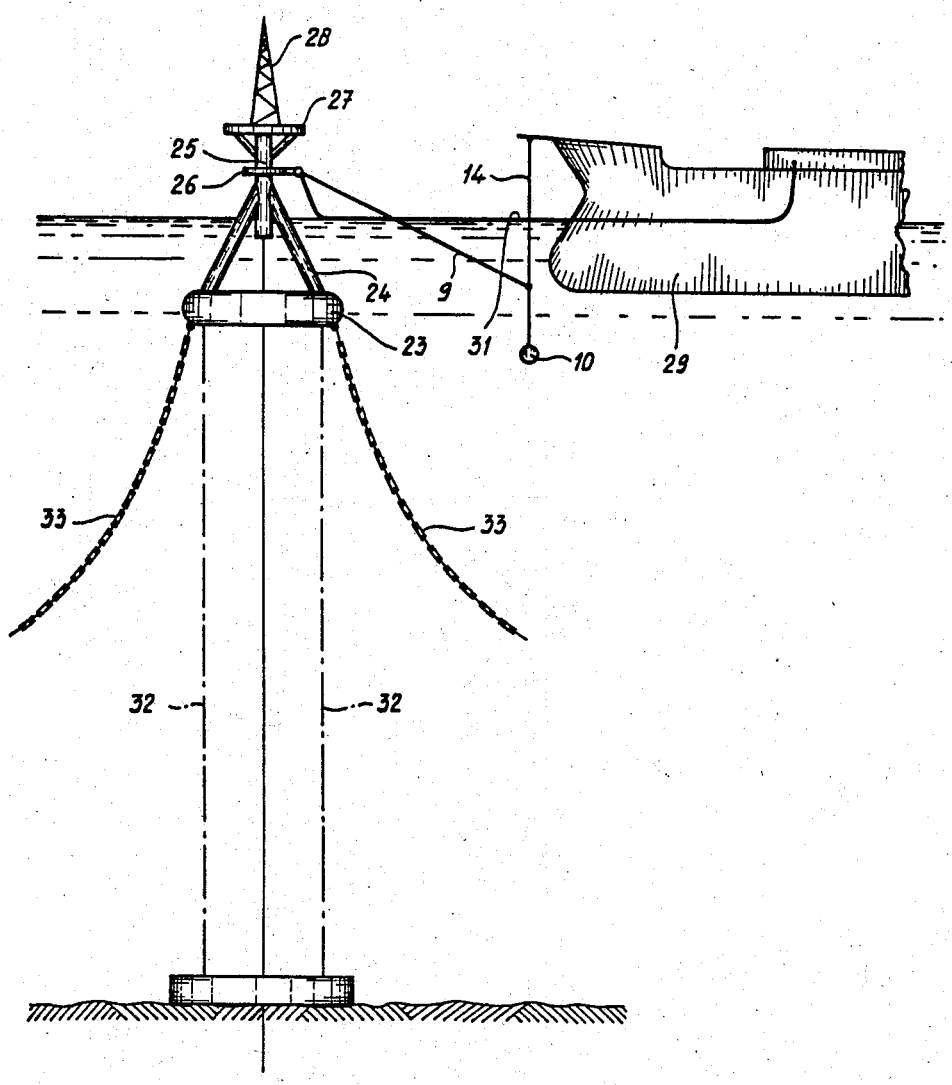

FIG. 2 shows a second embodiment.

The embodiment shown in FIG. 1 comprises a body 1 with buoyancy substantially formed by floats 2 e.g. in the form of four cylinders which are mutually connected by sleeves 4. Said cylinders 2 extend above the water level 3 but also may be below water level as indicated with the interrupted line. Said cylinders 2 support a central sleeve 5 by means of inclined sleeve like supports 6.

Instead of a sleeve 5 an open frame work can be used as well.

The lower side of sleeve 5 may be above water level as indicated with the interrupted line.

Said central column or sleeve 5 supports a rotatable ring 7 to which is attached pivotably at 8 a rigid arm 9, which is loaded by a weight 10 and which at 11 is suspended from a support 12 placed upon the bow of the vessel 13. The vertical connection 14 between the point of suspension 11 and the weight 10 can be connected with a bridge 15 which bridge may serve as well for supporting conduits. The outer end 16 of the bridge is swingably suspended by means of the arm 17 from the tower 18.

The other end 19 of bridge 15 is connected to the connection 14 at a location which is close to the end 11 of suspension, so that the point 19 moves only slightly with respect to the point 11 if the vessel moves away or back respectively with respect to the island 1 under the influence of currents or waves. The weight 10 in a known way provides a resilient connection, the so called soft yoke mooring system.

The central column 5 supports a plaform 20. The space between the platform 20 and the upper ends of the cylinders 2 is absolutely free, so that the arm 9 can swing around the column 5.

The body with buoyancy is connected with not shown bottom anchors by means of only schematically indicated vertical tension members 21. If desired additional anchor forces can be delivered by anchor chains 22.

In the embodiment of FIG. 2 the floating body 23 is almost entirely below water level. It supports by means of upwardly inclined supports 24 a central column 25 with rotatable ring 26 and a working platform 27 with drilling tower 28.

In this embodiment the vessel 29 is moored to the artificial island in substantially the same way as shown in FIG. 1 by using a rigid arm 9 and a rigid tension member 14 with a weight 10.

In this embodiment no bridge is provided and the conduit 31 is a floating conduit between the rotatable ring 26 and the vessel 29. The body with buoyancy is anchored by means of tension legs 32 and if desired in addition thereto with chains or cables 33.

I claim:

1. Apparatus comprising a buoyant body, a plurality of spaced apart vertical tension members which are exclusively designed for taking up tension load, bottom anchors located vertically below the buoyant body and to which lower ends of said vertical tension members are secured, said tension members pulling said buoyant body down against the buoyancy of the buoyant body, said buoyant body having buoyant parts substantially below water level and intersecting the water level with parts which above the water level support a portion for performing operations, the buoyant body carrying said portion for performing operations by means of a single vertical column which extends above the water level and which has horizontal dimensions which are smaller than those of the buoyant body, which column between the buoyant body and the portion for performing operations is surrounded by a rotatable ring having a stationary part connected to the column and a part movable with respect thereto around the column, said movable part having means for mooring a vessel and comprising a rigid arm rotatably connected about a horizontal axis to the movable part of the rotatable ring and at a distance from said horizontal axis being suspended from a vessel by means of a tension member which is loaded by means of a weight of a magnitude sufficient to maintain the vessel substantially in place with respect to the buoyant body, the area around the column and between the portion for performing operations and the top of the buoyant bodies and in which area the rotatable ring with rigid arm is located, being free of obstacles all around the column such that the vessel can freely swing around the column.

2. Apparatus as claimed in claim 1, and a further rigid arm which is pivotably connected to the tension member at one end and at its other end is suspended swingably from said portion for performing operations.

* * * * *